US006063206A

United States Patent [19]

Latta

[11] Patent Number: 6,063,206

[45] Date of Patent: May 16, 2000

[54] DE-OILING PROCESS USING ENZYMES

[75] Inventor: Charles J. Latta, Wheaton, Ill.

[73] Assignee: C. J. Latta & Associates, Wheaton, Ill.

[21] Appl. No.: 09/193,909

[22] Filed: Nov. 17, 1998

Related U.S. Application Data

[60] Provisional application No. 60/072,348, Jan. 23, 1998.

[51] Int. Cl.[7] ..... C23G 1/00

[52] U.S. Cl. ..... 134/2; 134/3; 134/10; 134/25.5; 134/26; 134/28; 134/29; 134/40; 134/41; 134/42; 510/245; 510/254; 510/274; 510/393; 510/421; 510/424; 435/264; 435/262; 435/281

[58] Field of Search ..... 134/2, 3, 10, 25.5, 134/26, 28, 29, 40, 41, 42; 510/245, 254, 274, 393, 421, 424; 435/262, 264, 281

[56] References Cited

U.S. PATENT DOCUMENTS

| | | | |
|---|---|---|---|
| 3,635,797 | 1/1972 | Battistoni et al. | 195/56 |
| 3,676,374 | 7/1972 | Zaki et al. | 252/551 |
| 3,804,714 | 4/1974 | Azoulay et al. | 195/28 R |
| 3,880,739 | 4/1975 | Leavitt | 195/28 R |
| 3,954,643 | 5/1976 | Krings et al. | 252/96 |
| 4,243,543 | 1/1981 | Guilbert et al. | 252/105 |
| 4,250,259 | 2/1981 | Hou et al. | 435/148 |
| 4,266,034 | 5/1981 | Patel et al. | 435/148 |
| 4,268,630 | 5/1981 | Patel et al. | 435/148 |
| 4,269,940 | 5/1981 | Patel et al. | 435/148 |
| 4,357,254 | 11/1982 | Kapiloff et al. | 252/181 |
| 4,608,189 | 8/1986 | Koch et al. | 252/174.22 |
| 4,780,150 | 10/1988 | Anderson et al. | 134/3 |
| 4,882,066 | 11/1989 | Portier | 210/679 |
| 4,941,989 | 7/1990 | Kramer et al. | 252/102 |
| 5,064,561 | 11/1991 | Rouillard | 252/174.12 |
| 5,093,236 | 3/1992 | Gonzales-Prevatt et al. | 435/9 |
| 5,156,761 | 10/1992 | Aaslyng et al. | 252/174.19 |
| 5,192,672 | 3/1993 | Lipscomb | 435/155 |
| 5,213,624 | 5/1993 | Williams | 134/40 |
| 5,236,832 | 8/1993 | Kiener | 435/117 |
| 5,253,665 | 10/1993 | Guirl | 134/201 |
| 5,265,674 | 11/1993 | Fredrickson et al. | 166/246 |
| 5,271,845 | 12/1993 | Paquin | 210/606 |
| 5,395,541 | 3/1995 | Carpenter et al. | 252/174.12 |
| 5,445,755 | 8/1995 | Convents et al. | 252/102 |
| 5,459,066 | 10/1995 | Mestetsky | 435/266 |
| 5,489,531 | 2/1996 | Benson | 435/264 |
| 5,514,277 | 5/1996 | Khudenko | 210/603 |
| 5,525,255 | 6/1996 | Leadingham et al. | 252/174.12 |
| 5,540,784 | 7/1996 | Ranes | 134/10 |
| 5,556,480 | 9/1996 | Rontome et al. | 134/26 |
| 5,571,446 | 11/1996 | Rouillard | 510/234 |
| 5,616,241 | 4/1997 | Khudenko | 210/151 |

*Primary Examiner*—Frankie L. Stinson
*Assistant Examiner*—S. Carrillo
*Attorney, Agent, or Firm*—Fitch, Even, Tabin & Flannery

[57] ABSTRACT

Compositions and methods are provided for cleaning and de-oiling metal parts and then degrading the removed oils or other organic compounds in an environmentally-friendly manner. The compositions generally contain surfactants to remove the oils and enzymes to degrade the oils. Generally, both aliphatic and aromatic compounds normally present in standard oils, lubricants, cutting oils, and greases are removed from the metal parts (i.e., "solubilized") by surfactants (although the enzymes may also assist in this process) and then ultimately broken down into relatively short-chain fatty acids by enzymes, both processes being carried out in an aqueous medium. The surfactants include (a) one or more alkylphenol ethoxylates; (b) one or more alkaline metal salts of an alkane sulfonic acid; and (c) one or more alkanolamines in aqueous solution. Suitable enzymes include monomethanoxigenase, alcoholdehydrogenase, and aldehydehydrogenase. Preferably, the aqueous enzyme solution contains all three types of the just-listed enzymes in order to degrade a wider variety of organic compounds derived form petroleum and petroleum products.

10 Claims, 1 Drawing Sheet

DE-OILING PROCESS USING ENZYMES

CROSS-REFERENCE TO RELATED APPLICATIONS

This application claims the benefit of a Provisional Application Ser. No. 60/072,348, filed Jan. 23, 1998.

FIELD OF THE INVENTION

This invention generally relates to compositions and methods for cleaning and de-oiling metal parts and the like using enzymes. More specifically, this invention relates to environmentally-friendly, aqueous-based compositions and methods for cleaning and dc-oiling metal parts and the like using enzymes to digest organic compounds on or removed from the metal parts. This invention also relates to environmentally-friendly, aqueous-based cleaning compositions containing specific surfactants and enzymes to remove and degrade organic compounds, including oil, petroleum, petroleum products, and the like, from metal parts and methods using such compositions.

BACKGROUND OF THE INVENTION

In the manufacturing and/or recycling of various metal parts (e.g., iron, brass, steel, aluminum, copper, alloyed, and the like parts) it is often necessary to clean the parts so that the manufacturing and/or recycling process can proceed or the part (or metal therefrom) can be used for its final intended purpose. Examples of such metal parts include, but are not limited to, machine parts, automotive parts, circuit boards, scrap metal parts, and the like. More specifically, it often become necessary to remove oils, greases, dirt, rolling oils, cutting oils, stamping oils, petroleum products, waxes, and/or other organic compounds or materials from the metal parts. Conventional processes in the past for removing such contaminants have generally involved the use of petroleum based hydrocarbon solvents such as, for example, petroleum distillates, halogenated hydrocarbon solvents, and the like. Although such solvents are generally very effective in removing oils and/or other organic materials, they present significant safety and environmental problems.

In recent years, efforts have been made to develop more environmentally acceptable processes for metal part cleaning—especially processes using aqueous-based cleaning solutions. For example, Williams, U.S. Pat. No. 5,213,624 (May 25, 1993), provided an oil-in-water microemulsion cleaning solution using a terpene solvent, an aliphatic glycol monoether co-solvent, surfactants, and water. Others have prepared various aqueous-based cleaning solutions containing various surfactants which are effective, to at least a limited degree, to remove the organic materials from the parts. Nonetheless, the disposal and/or treatment of the removed organic materials remains a problem. In some cases, the removed organic materials are separated from the water phase and then treated separately.

Even more recently, Ranes, U.S. Pat. No. 5,540,784 (Jul. 30, 1996), disclosed a method of cleaning the interior surfaces of industrial processing equipment (e.g., chemical and oil refinery equipment contaminated during use with oil and solid deposits) using an aqueous cleaning solution containing enzymes and a surfactant. The aqueous cleaning solution was circulated through the equipment under pressure and elevated temperatures (i.e., about 30 to 60 psi and about 220 to 260° F.) to remove the deposits. The enzymes were selected from the group consisting of proteases, amylases, lipases, cellulases, and mixtures thereof. The single surfactant was a long chain dimethyl amine oxide (e.g., lauryl dimethyl amine oxide, stearyl dimethyl amine oxide, myristyl dimethyl amine oxide). The enzymes are reported to help remove the oil deposits from the interior surfaces and then allow the oil and other organic materials to be separated from the aqueous phase and then removed to a waste storage tank.

Various enzymes and/or microorganisms have also been used for waste water or waste sludge treatment. For example, Paquin, U.S. Pat. No. 5,271,845 (Dec. 21, 1993) employed indigenous microorganisms (not otherwise specified) to treat waste sludge containing hydrocarbons. Fredrickson et al., U.S. Pat. No. 5,265,674 (Nov. 30, 1993), employed microorganisms to treat hydrocarbon-contaminated aquifers and other subsurface contaminated areas. Attempts have also been made to use microorganisms to treat oil spills in oceans and other waterways. Enzymes, in combination with various surfactants, have been used extensively in recent years in laundry and washing compositions in order to reduce phosphate loading to the environment. For example, Zaki et al., U.S. Pat. No. 3,676,374 (Jul. 11, 1972), used a proteolytic enzyme in a liquid detergent to assist soil removal.

None of the metal parts cleaning processes of which applicants are aware allow both effective removal of oils and other organic materials and effective degradation of the removed organic materials. It would be desirable, therefore, to provide such a process and compositions for carrying out such a process. It would also be desirable to provide a simplified metal parts cleaning process wherein, not only are oil and other hydrocarbons removed, but they are also degraded to environmentally more acceptable products. The compositions and processes of the present invention provide such metal cleaning compositions and processes.

SUMMARY OF THE INVENTION

This invention generally relates to compositions and methods for cleaning metal parts wherein the oil and other organic contaminates on the metals parts are removed from the metal parts and are degraded or otherwise broken down to environmentally acceptable products. The compositions and methods of the present invention provide an environmentally-friendly procedure for cleaning metal parts contaminated with oil and/or other organic compounds. Generally, both aliphatic and aromatic compounds normally present in standard oils, lubricants, cutting oils, and greases are removed from the metal parts (i.e., "solubilized") by surfactants (although the enzymes may also assist in this process) and then ultimately broken down into relatively short-chain fatty acids by enzymes, both processes being carried out in an aqueous medium. The surfactants include (a) one or more alkylphenol ethoxylates; (b) one or more alkaline metal salts of an alkane sulfonic acid; and (c) one or more alkanolamines in aqueous solution. Oil-degrading enzymes may also be used in the present invention. Suitable enzymes include, for example, monomethanoxigenase, alcoholdehydrogenase, and aldehydehydrogenase. Preferably, an aqueous enzyme solution containing all three types of the just-listed enzymes is used in order to degrade a wider variety of organic compounds derived form petroleum and petroleum products. The surfactants and enzymes can be used in series or in combination. In other words, the surfactants and enzymes can be used in the same or in separate aqueous solutions. For purposes of this invention, the term "enzyme" is intended to include purified or separated enzymes as well as enzyme complexes extracted from oil-degrading microbes or microorganisms. Such enzymes complexes may contain, in addition to the extracted enzymes, biosurfactants, cell debris, active and/or inactive microorganisms or microbes, and the like.

One object of the present invention is to provide an aqueous cleaning and de-oiling composition for metal parts contaminated with oil or other organic compounds, said composition comprising: (a) at least two alkylphenol ethoxylates of the general formula $$RC_6H_4(OCH_2CH_2)_xOH$$

wherein R is a long-chain aliphatic group containing at least seven carbon atoms and x for the first alkylphenol ethoxylate is in the range of about 1 to about 6 and x for the second alkylphenol ethoxylate is in the range of about 8 to about 12; (b) one or more alkaline metal salts of an alkane sulfonic acid; (c) one or more alkanolamines; and (d) water; wherein the composition is effective for removing the oil or other organic compounds derived from the contaminated metal parts. Preferably the composition also contains microbes and/or enzymes to degrade oil and/or other organic compounds. Examples of such enzymes include monomethanoxigenase, alcoholdehydrogenase, and aldehydehydrogenase.

Another object of the present invention is to provide an aqueous cleaning and de-oiling composition for metal parts contaminated with oil or other organic compounds, said composition comprising: (a) one or more alkylphenol ethoxylates; (b) one or more alkaline metal salts of alkane sulfonic acid; (c) one or more alkanolamines; (d) oil-degrading enzymes; and (e) water; wherein the composition is effective for removing and degrading the oil or other organic compounds derived from the contaminated metal parts and wherein the enzymes do not appreciably degrade the other components of the composition.

Another object of the present invention is to provide an aqueous cleaning and de-oiling composition for metal parts contaminated with oil or other organic compounds, said composition comprising: (a) at least two alkylphenol ethoxylates; (b) one or more alkaline metal salts of alkane sulfonic acid; (c) one or more alkanolamines; (d) at least two enzymes selected from the group consisting of monomethanoxigenase, alcoholdehydrogenase, and aldehydehydrogenase; and (e) water; wherein the composition is effective for removing and degrading the oil or other organic compounds derived from the contaminated metal parts and wherein the enzymes do not appreciably degrade the other components of the composition.

Still another object of the present invention is to provide an environmentally-friendly method for cleaning and de-oiling metal parts contaminated with oil or other organic compounds, said method comprising: (1) treating the metal parts contaminated with oil or other organic compounds with a first aqueous solution containing surfactants to remove the oil or other organic compounds from the metal parts and thereby solubilize oil or other organic compounds; and (2) treating the solubilized oil or other organic compounds with a second aqueous solution containing enzymes to degrade the oil or other organic compounds; wherein the surfactants in the first aqueous solution include (a) at least two alkylphenol ethoxylates; (b) one or more alkaline metal salts of alkane sulfonic acid; and (c) one or more alkanolamines; wherein the enzymes in the second aqueous solution are selected from the group consisting of monomethanoxigenase, alcoholdehydrogenase, and aldehydehydrogenase and do not appreciable degrade the surfactants from the first aqueous solution. The first and second aqueous solutions may be separate solutions or may be combined in a single solution. If a combined solution (i.e., surfactants and enzymes in a single aqueous solution) is used, it is preferred that the enzymes do not appreciably degrade the surfactants contained in the combined solution.

Still another objective of the present invention is to provide an environmentally-friendly method for cleaning and de-oiling metal parts contaminated with oil or other organic compounds, said method comprising: (1) treating the metal parts contaminated with oil or other organic compounds with a first aqueous composition containing surfactants to remove the oil or other organic compounds from the metal parts and thereby solubilize oil or other organic compounds; (2) treating the solubilized oil or other organic compounds with a second aqueous solution containing enzymes to degrade the oil or other organic compounds; and (3) once the second aqueous solution is no longer effective in degrading the oil or other organic compounds, treating the no-longer effective second aqueous solution with additional enzymes which will degrade the surfactants from the first aqueous solution; wherein the surfactants in first aqueous solution include (a) at least two alkylphenol ethoxylates; (b) one or more alkaline metal salts of alkane sulfonic acid; and (c) one or more alkanolamines; wherein the enzymes in second aqueous solution are selected from the group consisting of monomethanoxigenase, alcoholdehydrogenase, and aldehydehydrogenase and do not appreciable degrade the surfactants from the first aqueous solution.

These and other objects and advantages of the present invention will be apparent from a consideration of the present specification.

DETAILED DESCRIPTION OF THE INVENTION

Figure 1:
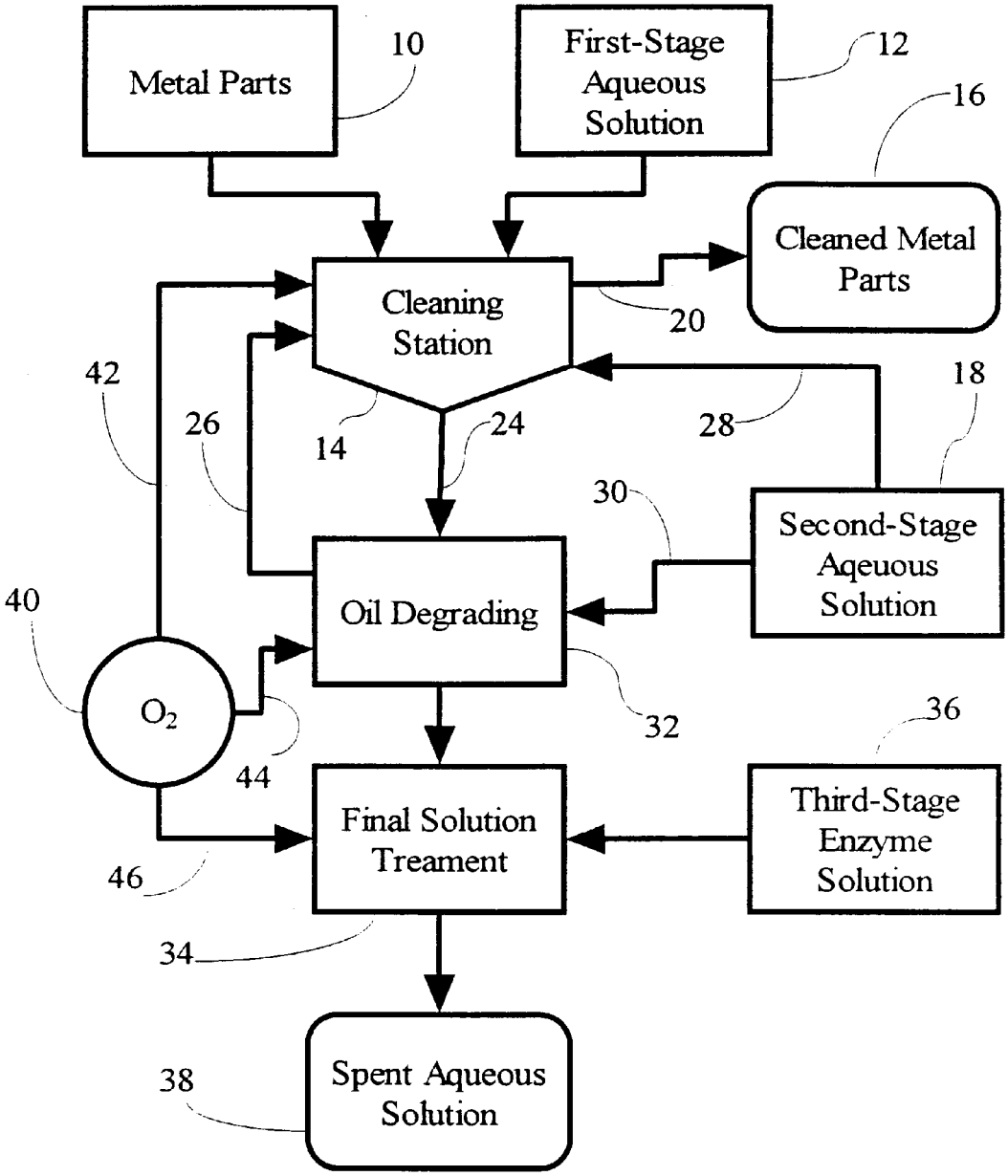
FIG. 1 is a flow diagram illustrating one embodiment of the process of this invention.

This invention generally relates to compositions and methods for cleaning metal parts wherein the oil and other organic contaminates on the metals parts are removed from the metal parts and are degraded or otherwise broken down to more environmentally acceptable products. The compositions and methods of the present invention provide an environmentally-friendly procedure for cleaning metal parts contaminated with oil and/or other organic compounds. Generally, both aliphatic and aromatic compounds normally present in standard oils, lubricants, cutting oils, and greases are removed from the metal parts (i.e., "solubilized") by surfactants (although the enzymes may also assist in this process) and then ultimately broken down—generally by oxidation processes—into relatively short-chain fatty acids by enzymes, both processes being carried out in an aqueous medium. The surfactants include (a) one or more alkylphenol ethoxylates; (b) one or more alkaline metal salts of alkane sulfonic acid; and (c) one or more alkanolamines in aqueous solution. Suitable enzymes include, for example, monomethanoxigenase, alcoholdehydrogenase, and aldehydehydrogenase. Preferably, the enzymes arc extracted from oil-degrading microbes. Preferably, the aqueous enzyme solution contains all three types of the just-listed enzymes in order to degrade a wider variety of organic compounds derived form petroleum and petroleum products. The surfactants and enzymes can be used in series or in combination. In other words, the surfactants and enzymes can be used in the same or in separate aqueous solutions.

The methods of this invention generally involve at least a two-step or stage process where, in the first step or stage, the oil and/or other organic materials are removed from the metal parts mainly by action of the aqueous surfactant solution and, in the second step or stage, the removed oil and/or other organic materials are degraded by the aqueous enzyme solution. The first and second stages may be carried out at the same time or in sequence. Preferably the enzymes in the second stage do not appreciably degrade the surfactants from the first stage or otherwise impair the effectiveness of the surfactants in removing oil and/or other organic materials from the metal parts being cleaned. In a preferred embodiment, a third stage may be employed whereby the spent aqueous solution containing the first stage surfactants, the second-stage enzymes, and the degraded oil and/or other organic materials is allowed to stand for a period of time in order to insure the complete or essentially compete degradation of the oil and/or organic matter. In an especially preferred embodiment, further enzymes may be added to the third stage solution in order to degrade the first-stage surfactants and/or further assist in degrading any oil and/or other organic materials not degraded by the second-stage enzymes. The use of such additional enzymes will, of course, generally reduce the time required for the third stages and/or improve the overall degradation process. The resulting aqueous solution (i.e., after suitable degradation in the third stage—with or without additional enzymes) can be discarded in an environmentally acceptable manner or used as, for example, scrubber, cooler, or mop bucket water. Thus, the present method can help meet ISO 14000 programs for reuse.

The surfactants used in the first stage are designed to effectively remove and/or solubilize oil and/or other organic materials that are commonly found on metal parts. The first stage aqueous surfactant solution contains (a) one or more alkylphenol ethoxylates; (b) one or more alkaline metal salts of alkane sulfonic acid; and (c) one or more alkanolamines. Preferably the first stage aqueous surfactant solution contains (a) at least two alkylphenol ethoxylates; (b) one or more alkaline metal salts of alkane sulfonic acid; and (c) one or more alkanolamines.

Suitable alkylphenol ethoxylates are of the general formula $$RC_6H_4(OCH_2CH_2)_xOH$$

wherein R is a long chain aliphatic group containing at least 7 carbon atoms and x is generally in the range of about 1 to about 12. The R group may be attached to various positions on the aromatic ring structure; the R group may be either a straight or branched group. Preferably, R is either an nonyl ($—C_9H_{19}$) or an octyl ($—C_8H_{17}$) aliphatic group. Preferably both a relatively low molecular weight alkylphenol ethoxylate (i.e., x in the range of about 1 to 6) and a relatively high molecular weight alkylphenol ethoxylate (i.e., x in the range of about 8 to about 12) are present in the aqueous first stage surfactant solution. Although not wishing to be limited by theory, it is thought that the lower molecular weight alkylphenol ethoxylate helps assist in the removal and/or solubilization of higher molecular weight hydrocarbons (including greases and higher viscosity hydrocarbons) and that the higher molecular weight alkylphenol ethoxylate helps assist in the removal and/or solubilization of lower molecular weight hydrocarbons (including volatile organic compounds). If only one alkylphenol ethoxylate is employed in the aqueous first-stage surfactant solution, then the higher molecular weight alkylphenol ethoxylate (i.e., x in the range of about 8 to about 12) preferably should be used. The higher weight alkylphenol ethoxylate also contributes to the overall detergency as well. It is preferred, however, that both the higher and lower molecular weight materials be used in combination. Generally the nonylphenol ethoxylate surfactants are preferred. Especially preferred nonylphenol ethoxylate surfactants are, in combination, $C_9H_{19}C_6H_4(OCH_2CH_2)_{9.5}OH$ (Surfonic N95 from Huntsman); molecular weight about 638) and $C_9H_{19}C_6H_4(OCH_2CH_2)_4OH$ (Surfonic N40 from Huntsman); molecular weight about 396). Various mixtures of nonylphenol and octylphenol ethoxylate surfactants can also be used if desired. Generally the higher molecular weight alkyphenol ethoxylates has a HLB value of about 12.0 to about 19.0, more preferably about 12.4 to about 13.5. Generally the lower molecular weight alkyphenol ethoxylates has a HLB value of about 3.4 to about 11.9, more preferably about 7.5 to about 10.0.

The second surfactant in the first-stage aqueous solution is an alkaline metal salt of an alkane sulfonic acid. Suitable alkaline metal salts of alkane sulfonic acid are of the general formulae $R\ SO_3^-M^+$ and $ArSO_3^-M^+$ wherein R is an aliphatic group containing at least 7 carbon atoms, Ar is a substituted or unsubstitued aromatic group, and $M^+$ is an alkaline metal cation. Preferred alkaline metal cations in include sodium and potassium, with sodium being most preferred. Suitable $RSO_3^-$ and $ArSO_3^-$ anions include, for example, olefin sulfonates, aliphatic sulfonates, benzenesulfonate, toluenesulfonate, dodecylbenzenesulfonate, and the like. Although not wishing to be limited by theory, it is thought that the sulfonates provide detergency capabilities and help to prevent re-adherence of the oil on the metal parts once it has been removed. Preferably this second surfactant in the first-stage aqueous solution is the sodium salt of substituted benzenesulfonate such as p-toluenesulfonate, dodecylbenzenesulfonate, and the like or Bio Terg PAS-8S (primary alkane sulfonate) from Stepan Chemical.

The third surfactant in the first-stage aqueous solution is an alkanolamine. Suitable alkanolamines are of the general formula $(HO(CH_2)_z)_{3-y}NH_y$ wherein z is equal to or greater than 2 and y is 0, 1, or 2. Preferably, z is in the range of 2 to 6 and y is 0 or 1. Preferably, trialkanolamines of the general formula $(HO(CH_2)_z)_3N$, where z is in the range of 2 to 6, are used. More preferably, z is equal to 2 and y is 0, in which case the alkanolamine is triethanolamine. Use of triethanolamine allows the pH of the first-stage aqueous solution to be easily maintained in an especially desirable range (i.e., less than about 8). Although not wishing to be limited by theory, it is thought that the alkanolamines help to prevent re-adherence of the oil on the metal parts once it has been removed and help to prevent rusting.

Generally the first-stage aqueous solution contains about 1 to about 20 weight percent of alkylphenol ethoxylates, about 0.5 to about 5 weight percent of alkaline metal salts of alkane sulfonic acid, and about 2 to about 10 weight percent of alkanolamines. Preferably the first-stage aqueous solution contains about 0.5 to about 10 weight percent of a high molecular weight alkylphenol ethoxylate, about 0.5 to about 10 weight percent of a low molecular weight alkylphenol ethoxylate, about 0.5 to about 5 weight percent of alkaline metal salts of alkane sulfonic acid, and about 2 to about 10 weight percent of alkanolamines. Even more preferably, the first-stage aqueous solution contains about 1 to about 5 weight percent of a high molecular weight alkylphenol ethoxylate, about 1 to about 5 weight percent of a low molecular weight alkylphenol ethoxylate, about 1 to about 4 weight percent of alkaline metal salts of alkane sulfonic acid, and about 2 to about 5 weight percent of alkanolamines. An especially preferred first-stage aqueous solution would contains about 1 to about 5 weight percent of an alkylphenol ethoxylate of general formula $RC_6H_4(OCH_2CH_2)_xOH$ wherein R is nonyl ($—C_9H_{19}$) and x is generally in the range of about 8 to about 12, about 1 to about 5 weight percent of an alkylphenol ethoxylate of general formula $R''C_6H_4(OCH_2CH_2)_xOH$ wherein R" is nonyl ($—C_9H_{19}$) and x is generally in the range of about 1 to about 6, about 1 to about 4 weight percent of a sodium salt of an alkane sulfonic acid, and about 2 to about 5 weight percent of a trialkanolamine of the general formula $(HO(CH_2)_z)_3N$ wherein z is in the range of 2 to 6.

One especially preferred first-stage aqueous solution is prepared from CJ's Cleaner and Degreaser available from C. J. Latta and Associates of Wheaton, Ill. This concentrate contains the following surfactants: Surfonic N95 (nonyl phenol ethoxylates with an average molecular weight of about 638) at about 3 weight percent; Surfonic N40 (nonyl phenol ethoxylates with an average molecular weight of about 396) at about 2 weight percent; Bio-Terge PAS-8S at about 3 weight percent; and triethanolamine at about 3 weight percent. The concentrate is generally used at about 1 gallon per 5 gallons of water. Greater or lesser amounts of the concentrate can be used depending on the oil loading from the metal parts to be cleaned.

The oil-degrading enzymes may be present with the surfactants in the first-stage aqueous solution or in a separate second-stage aqueous solution. Examples of enzymes useful in this invention include monomethanoxigenases, alcoholdehydrogenases, and aldehydehydrogenases. Preferably the second-stage aqueous solution contains at least two of these enzymes and most preferably all three enzymes. The second-stage aqueous solution may also contain other enzymes in addition to those just listed. Preferably the enzymes are separated from their microbe counterparts. Preferably the enzymes or enzyme complexes are extracted from *Pseudomonas fluorescence,* Pseudomonas sp, *Pseudomonas putida,* Anthrobacter, and/or Rhodococcus bacterial strains. Although other strains can be used, they are generally not as effective (i.e., slower) in degrading oil. One especially preferred source of the enzymes or enzyme complex is the Multi-Enzyme Complex from ETEC (Troutdale, Oreg.). According to the manufacturer, the Multi-Enzyme Complex is produced by "peeling" the skin from lyophilized *Pseudomonas fluorescence* and Pseudomonas sp bacterial strains and then extracting the naturally-occurring biosurfactants and enzyme complexes. The microbial strains used to produce the preferred Multi-Enzyme Complex are derived from naturally-occurring strains of oil-degrading microbes. Other similar oil degrading strains, whether naturally-occurring or genetically engineered, of the *Pseudomonas fluorescence,* Pseudomonas sp, *Pseudomonas putida,* Anthrobacter, and/or Rhodococcus types or other oil degrading types can also be used. Of course, other enzymes which may also degrade oil, grease, and other organic materials may also be present in the second-stage aqueous solution along with the preferred monomethanoxigenase, alcoholdehydrogenase, and/or aldehydehydrogenase enzymes.

The preferred monomethanoxigenase, alcoholdehydrogenase, and aldehydehydrogenase enzymes degrade oil and other organic materials (both aliphatic or aromatic hydrocarbons) which have been solubilized by the surfactants in the first-aqueous stage via oxidation reactions to at least initially form fatty acids which can more easily be oxidized or degraded. Providing an oxygen source significantly increases the oxidation rates. Suitable oxygen sources include, for example, hydrogen peroxide, air, oxygen-enriched air, and oxygen gas. To assist oil degradation, oxygen is introduced into the aqueous medium containing the solubilized oil or other organic materials and enzymes. Preferably the oxygen is in the form of small bubbles (e.g., about 0.1 to about 10 mm in diameter, more preferably about 1 to about 3 mm in diameter, and most preferably about 2 mm in diameter). The oxygen bubbling also assists in mixing and/or agitating the reaction mixture.

Generally the enzyme mixture is added at about 0.1 to about 2.0 weight percent based on the total weight of the first-stage aqueous solution. Of course, greater or lesser amounts can be used if appropriate. For example, with especially oiled or soiled parts, higher levels may be preferred. Generally, levels less than about 0.2 to about 0.3 percent result in slowed performance and, for normal to heavy levels of oil contamination, may not allow the cleaning compositions to "stay ahead" of the oil introduced into the solution. Of course, where only relatively low levels of oil contamination are expected, such lower levels of enzyme or enzyme complex may be cost effective. For normal levels of oil contamination, generally adding about ½ ounce of the enzymes or enzyme complex or mixture per about 3 to about 8 pounds of hydrocarbon expected to be introduced into the system is acceptable. For normal levels of oil contamination, about 0.5 to about 1.0 weight percent of enzymes or enzyme complex based on the total weight of the first-stage aqueous solution has been found to be a reasonable usage rate based on performance and cost; more preferably, the level of enzymes or enzyme complex is in the range of about 0.6 to about 0.8 weight percent based on the total weight of the first-stage aqueous solution.

As noted above, the oil-degrading enzymes may be present with the surfactants in the first-stage aqueous solution or in a separate second-stage aqueous solution. If added to, or present in the, the first-stage aqueous solution, the enzymes may assist the surfactants in the cleaning operation; thus, the enzymes may help to soften baked or cooked on grease and/or oil. Used in this manner, the first-stage aqueous surfactant solution and the second-stage aqueous enzyme solution become, in effect, a single cleaning aqueous solution. The enzymes may also be added as a separate aqueous solution, thereby employing separate first-stage and second-stage aqueous solution. For purposes of this invention, the second-stage aqueous enzyme solution is intended to include the enzymes alone or combined with water (with or without the surfactants from the first-stage aqueous surfactant solution). In other words, the enzyme complex (without added water) can be added to the first-stage aqueous solution to form the second-stage aqueous solution or the enzyme complex can first be taken up in an aqueous solution and then added to the first-stage aqueous solution to form the second-stage aqueous solution or the enzyme complex can be in a separate aqueous solution. Moreover, the enzymes (powdered or in aqueous solution or suspension) can be incorporated in a single addition step (e.g., at the beginning of the cleaning operation) or in multiple addition steps throughout the cleaning operation. Thus, if desired or appropriate (e.g., with increased oil loading to the system), additional enzymes can be added to the cleaning solution during the cleaning operation to enhance the cleaning/degrading activity.

In one preferred embodiment, the first-stage aqueous surfactant solution and the second-stage enzyme solution are combined in a single aqueous cleaning/degrading solution. An especially preferred combined cleaning/degrading solution is prepared from CJ's Cleaner and Degreaser and ETEC's Multi-Enzyme Complex. Once such preferred combined cleaning/degrading solution contains Surfonic N95 at about 3 weight percent; Surfonic N40 at about 2 weight percent; Bio-Terge PAS-8S at about 2 weight percent; triethanolamine at about 3 weight percent; and Multi-Enzyme Complex at about 0.6 weight percent. Greater or lesser amounts of surfactants and/or enzymes can be used depending on the oil loading from the metal parts to be cleaned.

The enzymes included in the second-stage aqueous solution should not appreciably degrade the surfactants included in the first-stage aqueous solution. Following complete or relatively complete degradation of the aliphatic and aromatic hydrocarbons derived from the metal parts, additional enzymes can be added, if desired, to the resulting aqueous solution in order to degrade the surfactants introduced in the first-stage aqueous solution and any remaining oil or other organic materials derived from the metal parts. This additional enzyme treatment or third-stage aqueous solution treatment allows the aqueous solution to be reuse as wash water (e.g., scrubber or mop bucket water) or otherwise allows the aqueous solution to be more easily disposed of in an environmentally acceptable manner. The enzymes for this additional or final treatment step can be the same as, or different from, the enzymes used in the second-stage aqueous solution. Preferred enzymes in the final treatment step include ETEC's Multi-Enzyme Complex and a pseudomonas blend (tradename ABR Microbial Complex) from Sybron (Birmingham, N.J.). Preferably, enzymes used in the final treatment step will also degrade the surfactants used in the first aqueous solution. Thus, Sybron's ABR Microbial Complex is preferred in the last treatment step. Generally these additional enzymes are added to the spent-second-stage aqueous solution at a level of about 0.1 to about 10 weight percent, and more preferably at a level of about 0.5 to about 5 weight percent.

The process of this invention may be operated in a batch, semi-continuous, or continuous mode. One embodiment of the present invention is illustrated in FIG. 1. The metal parts 10 to be cleaned and the first-stage aqueous solution 12 containing the surfactants are brought together in cleaning station 14. Although not shown, the mixture in the cleaning station 14 may be agitation by conventional means in order to speed up removal of the oil and other organic materials from the metal parts. For example, the first-stage aqueous solution may be continuously circulated through the cleaning station by means of a pump (not shown) in order to provide agitation. Once the oil and other organic materials are removed from the metal parts in cleaning station 14, the cleaned metal parts 16 are removed and then treated in a conventional manner (e.g., treated with a rust inhibitor, drained, dried, or the like) depending on the ultimate use of the cleaned metal parts. (Aqueous solution drained from the removed metal parts 16 can be, if desired, returned or recycled to the cleaning station 14.) The first-stage aqueous solution, now containing the oil and other organic materials removed from the metal parts, is removed from cleaning station 14 via line 24 to the oil degrading station 32 where the enzymes from the second-stage aqueous solution 18 are added via line 30. If desired, the enzymes from the second-stage aqueous solution 18 could also have been added to the cleaning station 14 via line 28 in order to assist in removal of oil and other organic materials and/or to begin oil degradation in the cleaning station 14. To assist oil degradation, oxygen 40 is introduced via line 44 into oil degradation station 32, preferably in the form of small bubbles (e.g., about 0.1 to about 10 mm in diameter, more preferably about 1 to about 3 mm in diameter, and most preferably about 2 mm in diameter). Especially if enzymes from the second-stage aqueous solution 18 are introduced into cleaning station 14, oxygen 40 can also be introduced into cleaning station 14 via line 42. Oxygen introduced into cleaning station 14 is preferably in the form of small bubbles (e.g., about 0.1 to about 10 mm in diameter, more preferably about 1 to about 3 mm in diameter, and most preferably about 2 mm in diameter). The use of oxygen bubbles in cleaning station 14 will, in addition to assisting any enzymes present in breaking down organic materials, also assist in agitating the cleaning solution thereby speeding up removal of organic materials from the metal parts. Such small bubbles can be produced using a gas diffuser or other conventional means.

Once sufficient oil degradation has occurred in station 32, the resulting aqueous solution contained therein can be recirculated via line 26 to be reused in cleaning station 14. The recycled aqueous solution from station 32 will contain both surfactants from the first-stage aqueous solution 12 and enzymes from the second-stage aqueous solution 18. In operation, the recycled aqueous solution can be reused in cleaning station 14 and oil degrading station 32 for a number of cycles. Make-up first-stage aqueous solution 16 and/or second-stage aqueous solution 18 can be added to cleaning station 14 and make-up second stage aqueous solution can be added to oil degrading station 32 as needed. At some point, however, the recycled aqueous solution from oil degrading station will no longer be effective in either removing oil or other organic materials from the metal parts in cleaning station 14 and/or degrading the oil or other organic materials in oil degrading station 32 and will need to be removed from use. Such spent recycled aqueous solution is removed to final solution treatment station 34 where it can be, if desired, treated with a final enzyme solution or third-stage aqueous solution 36. The third-stage aqueous solution 36 contains enzymes which will break down the surfactants from the first-stage aqueous solution. To assist the degradation of the surfactants (and any residual oil or other organic materials not broken down in oil degradation station 32), oxygen 40 is introduced via line 46, preferably in the form of small bubbles (e.g., about 0.1 to about 10 mm in diameter, more preferably about 1 to about 3 mm in diameter, and most preferably about 2 mm in diameter). Finally, after treatment in 34, the spent aqueous solution 38 is removed. The spent aqueous solution 38 can be recycled in the process (i.e., used to prepare first- or second-stage solutions 12 and/or 18) or otherwise used (i.e., as scrubber or mob bucket water) or disposed of in an environmentally acceptable manner. The spent aqueous solution 38 will generally contain relatively short-chain fatty acids resulting from the enzymatic breakdown of the oil or other organic materials removed from the metal parts as well as acetylated coenzyme A (i.e., $CH_3C(=O)CoA$) derived from the enzymes.

Generally, the aqueous solution containing first-stage surfactants and second-stage enzymes in cleaning station 14 and oil degrading station 32 can be used for about 4 weeks (depending on the oil loading) before it begins to significantly decrease in its cleaning ability. As shown in FIG. 1, the spent aqueous solution is then transferred to final treatment station 34 where (with or without the third-stage aqueous solution 36) it is allowed to remain for about 2 weeks to about 2 months (preferably about 1 month) to allow oil degradation to be completed. If desired, the third-stage aqueous solution 36 (if used) can be added during this time period or after completion of the oil degradation process.

The third-stage aqueous solution 36 may be formed by simply adding the appropriate enzymes to the aqueous solution in the final treatment station 34 or prepared as a separate aqueous solution. Of course, more than one final solution treatment station 34 can be used to increase throughput and more easily accommodate semi-continuous or continuous operation.

The temperature in the cleaning station 14, oil degrading station 32, and final solution treatment station 34 is maintained at temperatures at which the enzymes and/or microbes can operate efficiently. Generally, it is preferred that the temperature be maintained at about 80 to about 120° F. and more preferably at about 80 to about 95° F. in station 34 and about 115 to about 120° F. in stations 14 and 32. Any suitable heating means can be used to maintain the temperature in the proper operating range. Such elevated temperatures will also improve the efficiency of the solubilization step in cleaning station 14. As one of ordinary skill in the art will realize, the optimum temperature will depend on the specific enzymes/microbes used and can be determined by routine experimentation.

As one of ordinary skill in the art will realize, the process outlined in FIG. 1 could easily be modified to take into account modifications in the process. For example, cleaning station 14 and oil degrading station 32 could be combined in a single unit. Or a plurality of cleaning stations 14 and oil degrading stations 32 could be combined in a single process. Or a single cleaning station 14 could be combined with a number of oil degrading stations 32 so that recycled aqueous solution would be available for recycling to the cleaning station 14 on a more frequent basis. In fact, if enough oil degrading stations are included, the recycled aqueous solution could be available on an essentially continuous basis therefore allowing for essentially continuous operation of the process.

The oil degrading station or stations 32 of FIG. 1 could also contain a means or support system for allowing the enzymes and/or microbes to collect and/or grow on the means or support system. For example, the oil degrading station or stations could contain a filter comprising a carbon mat and a plastic mesh material. Such a filter is available from Independent Biotechnology, Inc. (Lockport, Ill.). The carbon mat helps to absorb or "pull out" hydrocarbons from the aqueous solution and, along with the plastic mesh, provides a growth structure to support the growing microbes (i.e., "bio-mass") in the oil degrading station. The hydrocarbons are degraded as they pass through or are absorbed on the filter. The filter would allow the system to better handle "surges" or excess amounts of hydrocarbons in the process by absorbing them on the carbon mat and then allowing degradation of the absorbed materials. Such a filter could also help to increase surface contact time on the enzymes/microbes with the hydrocarbons to increase the efficiency of the degradation process. Once the bio-mass builds to the point of clogging the filter (and thereby reducing throughput to a significant extent), the filter can be removed, cleaned, and then replaced or simply replaced by a new filter.

While there has been illustrated and described preferred embodiments of the present invention, it will be appreciated that numerous changes and modifications may occur to those skilled in the art, and it is intended in the appended claims to cover all those changes and modifications which fall within the true spirit and scope of the present invention.

What is claimed is:

1. An environmentally-friendly method for cleaning and de-oiling metal parts contaminated with oil or other organic compounds, said method comprising the steps of:

1) providing a first chamber containing the metal parts;
2) treating the metal parts contaminated with oil or other organic compounds with a first aqueous solution containing surfactants to remove the oil or the other organic compounds from the metal parts and thereby solubilize the oil or the other organic compounds and form a second aqueous solution containing the surfactants, and solubilized oil or the other organic compounds in the first chamber;
3) removing the metal parts from the second aqueous solution;
4) treating the surfactants and the solubilized oil or the other organic compounds in the second aqueous solution with a third aqueous solution containing oil-degrading enzymes to degrade the oil or the other organic compounds and form a fourth aqueous solution containing the oil-degrading enzymes, the surfactants and degraded oil or other degraded organic compounds in the first chamber;
5) transferring the fourth aqueous solution to a second chamber; and
6) treating the fourth aqueous solution in the second chamber with additional oil-degrading enzymes, wherein the additional oil-degrading enzymes further degrade the surfactants from the first aqueous solution and any undegraded oil or undegraded organic compounds remaining in the fourth aqueous solution;

wherein the surfactants in the first aqueous solution include (a) at least two alkylphenol ethoxylates; (b) one or more alkaline metal salts of alkane sulfonic acid; and © one or more alkanolamines.

2. The method as defined in claim 1, wherein the first aqueous solution contains at least two alkylphenol ethoxylates of the general formula $$RC_6H_4(OCH_2CH_2)_xOH$$

wherein R is either an nonyl or an octyl group and x is generally in the range of about 1 to about 12; one or more alkaline metal salts of alkane sulfonic acid of the general formula $ArSO_3^-M^+$ where Ar is a substituted or unsubstitued aromatic group and $M^+$ is an alkaline metal cation; and one or more alkanolamines of the general formula $(HO(CH_2)_z)_3N$ where z is in the range of 2 to 6; and wherein the oil-degrading enzymes of the third aqueous solution are selected from the group consisting of monomethanoxigenase, alcoholdehydrogenase, and aldehydehydrogenase.

3. The method as defined in claim 2, wherein at least a first and a second alkylphenol ethoxylates are present in the first aqueous solution, wherein, for the first alkylphenol ethoxylate, x is in the range of about 1 to about 6 and, for the second alkylphenol ethoxylate, x is in the range of about 8 to about 12.

4. The method as defined in claim 3, wherein, for the first aqueous solution, first alkylphenol ethoxylate is present at about 0.5 to about 10 weight percent, the second alkylphenol ethoxylate is present at about 0.5 to about 10 weight percent, the one or more alkaline metal salts of the alkane sulfonic acid are present at about 0.5 to about 5 weight percent, and the one or more alkanolamines are present at about 2 to about 10 weight percent; and wherein, for the third aqueous solution, the oil-degrading enzymes are present at a level of about 0.2 to about 2 weight percent.

5. The method as defined in claim 4, wherein at least three oil-degrading enzymes selected from the group consisting of monomethanoxigenase, alcoholdehydrogenase, and aldehydehydrogenase are present in the third aqueous solution.

6. An environmentally-friendly method for cleaning and de-oiling metal parts contaminated with oil or other organic compounds, said method comprising the steps of:

1) providing a first chamber containing the metal parts;

2) treating the metal parts contaminated with oil or other organic compounds with a first aqueous solution containing surfactants to remove the oil or the other organic compounds from the metal parts and thereby solubilize the oil or the other organic compounds and form a second aqueous solution containing the surfactants, and solubilized oil or the other organic compounds in the first chamber;

3) removing the metal parts from the second aqueous solution;

4) treating the surfactants and the solubilized oil or the other organic compounds in the second aqueous solution with a third aqueous solution containing oil-degrading enzymes to degrade the oil or the other organic compounds and form a fourth aqueous solution containing the oil-degrading enzymes, the surfactants and degraded oil or other degraded organic compounds in the first chamber;

5) once the third aqueous solution is no longer effective in degrading the oil or the other organic compounds, transferring the fourth aqueous solution to a second chamber; and 6) treating the fourth aqueous solution in the second chamber with additional oil-degrading enzymes, wherein the additional oil-degrading enzymes further degrade the surfactants from the first aqueous solution and any undegraded oil or undegraded organic compounds remaining in the fourth aqueous solution;

wherein the surfactants in the first aqueous solution include (a) at least two alkylphenol ethoxylates; (b) one or more alkaline metal salts of alkane sulfonic acid; and © one or more alkanolamines; and wherein the oil-degrading enzymes in the third aqueous solution are selected from the group consisting of monomethanoxigenase, alcoholdehydrogenase, and aldehydedehydrogenase.

7. The method as defined in claim 6, wherein the first aqueous solution contains alkylphenol ethoxylates of the general formula $$RC_6H_4(OCH_2CH_2)_xOH$$

wherein R is either an nonyl or an octyl group and x is generally in the range of about 1 to about 12; alkaline metal salts of alkane sulfonic acid of the general formula $ArSO_3^-M^+$ where Ar is a substituted or unsubstitued aromatic group and $M^+$ is an alkaline metal cation; and alkanolamines of the general formula $(HO(CH_2)_z)_3N$ where z is in the range of 2 to 6.

8. The method as defined in claim 7, wherein at least a first and a second alkylphenol ethoxylates are present in the first aqueous solution, wherein, for the first alkylphenol ethoxylate, x is in the range of about 1 to about 6 and, for the second alkylphenol ethoxylate, x is in the range of about 8 to about 12.

9. The method as defined in claim 8, wherein, for the first aqueous solution, first alkylphenol ethoxylate is present at about 0.5 to about 10 weight percent, the second alkylphenol ethoxylate is present at about 0.5 to about 10 weight percent, the alkaline metal salts of the alkane sulfonic acid are present at about 0.5 to about 5 weight percent, and the alkanolamines are present at about 2 to about 10 weight percent; wherein, for the second aqueous solution, the oil-degrading enzymes in the third aqueous solution are present at a level of about 0.2 to about 2 weight percent; and wherein, for step (6), the additional oil-degrading enzymes are added at a level of about 0.5 to about 5 weight percent.

10. The method as defined in claim 9, wherein at least three oil-degrading enzymes selected from the group consisting of monomethanoxigenase alcoholdehydrogenase, and aldehydehydrogenase are present in the third aqueous solution.

* * * * *